US009626920B2

(12) United States Patent
Suyama et al.

(10) Patent No.: US 9,626,920 B2
(45) Date of Patent: Apr. 18, 2017

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Tatsuhiko Suyama, Osaka (JP); Kouji Kumada, Osaka (JP); Norio Ohmura, Osaka (JP); Noriyuki Tanaka, Osaka (JP); Takuya Sone, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 189 days.

(21) Appl. No.: 14/438,981

(22) PCT Filed: Nov. 13, 2013

(86) PCT No.: PCT/JP2013/080628

§ 371 (c)(1),
(2) Date: Apr. 28, 2015

(87) PCT Pub. No.: WO2014/080812

PCT Pub. Date: May 30, 2014

(65) Prior Publication Data

US 2015/0302809 A1 Oct. 22, 2015

(30) Foreign Application Priority Data

Nov. 20, 2012 (JP) ..... 2012-254457

(51) Int. Cl.
*G09G 3/36* (2006.01)

(52) U.S. Cl.
CPC ..... *G09G 3/3611* (2013.01); *G09G 3/3614* (2013.01); *G09G 3/3648* (2013.01);
(Continued)

(58) Field of Classification Search
CPC ..... G09G 3/3611; G09G 3/3614
See application file for complete search history.

(56) References Cited

U.S. PATENT DOCUMENTS

2004/0021625 A1* 2/2004 Lee ..... G09G 3/3614 345/87
2004/0036669 A1* 2/2004 Yanagi ..... G06F 1/3218 345/98

(Continued)

FOREIGN PATENT DOCUMENTS

JP 2003-337577 A 11/2003
JP 2005-215591 A 8/2005

*Primary Examiner* — Dorothy Harris
(74) *Attorney, Agent, or Firm* — Keating & Bennett, LLP

(57) ABSTRACT

In a liquid crystal display device for performing pause driving, occurrence of flicker is effectively suppressed while an increase in power consumption is suppressed.

When a frame in which an image signal (DAT) is inputted from an external portion without output of a request signal (RO) for requesting the external portion to input the image signal (DAT) is defined as a first input frame, a reversal driving control portion (10) sets the reversal driving technique in the first input frame to the column-reversal driving while setting the first input frame to a refresh frame defined as a first refresh frame, sets three frames subsequent to the first refresh frame to pause frames, sets a frame subsequent to the final pause frame to a refresh frame defined as a second refresh frame, and sets the reversal driving technique in the second refresh frame to the dot-reversal driving.

11 Claims, 9 Drawing Sheets

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| REQOUT | | | | RO | RO | | | | | | | RO | RO | | | | | | | | | | RO | RO | | | | | | |
| DATA | A | | | | A | A | | | A | | | | A | A | | | | | | A | | | | A | A | | | | | |
| REF/NREF | R | N | N | N | R | R | N | N | R | N | N | N | R | R | N | N | N | N | N | R | N | N | N | R | R | N | N | N | N | N |
| Driving | C | | | | D | D | | | C | | | | D | D | | | | | | C | | | | D | D | | | | | |
| VCOM | VCOM2 | | | | VCOM1 | | | | VCOM2 | | | | VCOM1 | | | | | | | VCOM2 | | | | VCOM1 | | | | | | |
| NREF_Cnt | | 1 | 2 | 3 | | | 1 | 2 | | 1 | 2 | 3 | | | 1 | 2 | 3 | 4 | 5 | | 1 | 2 | 3 | | | 1 | 2 | 3 | 4 | 5 |
| REF_Cnt | 1 | | | | 2 | 3 | | | 1 | | | | 2 | 3 | | | | | | 1 | | | | 2 | 3 | | | | | |

| Frame | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 |
|---|---|---|---|---|---|---|---|---|---|---|---|---|---|---|---|---|---|---|---|---|---|---|---|---|---|---|---|---|---|---|
| REQOUT | | | | | RO | RO | | | | | | RO | RO | | | | | | RO | RO | | | | | | | | | | RO |
| DATA | | A | | | | A | A | | B | | | | B | B | | C | | | | C | C | | | | | | | | | |
| REF/NREF | N | R | N | N | N | R | R | N | R | N | N | N | R | R | N | R | N | N | N | R | R | N | N | N | N | N | N | N | N | N |
| Driving | | C | | | | D | D | | C | | | | D | D | | C | | | | D | D | | | | | | | | | |
| VCOM | | VCOM2 | | | | VCOM1 | | | VCOM2 | | | | VCOM1 | | | VCOM2 | | | | VCOM1 | | | | | | | | | | |
| NREF_Cnt | 6 | | 1 | 2 | 3 | | | 1 | | 1 | 2 | 3 | | | 1 | | 1 | 2 | 3 | | | 1 | 2 | 3 | 4 | 5 | 6 | 7 | 8 | 9 |
| REF_Cnt | | 1 | | | | 2 | 3 | | 1 | | | | 2 | 3 | | 1 | | | | 2 | 3 | | | | | | | | | |

(52) U.S. Cl.
CPC . *G09G 2310/08* (2013.01); *G09G 2320/0247* (2013.01); *G09G 2320/103* (2013.01); *G09G 2340/0435* (2013.01)

(56) References Cited

U.S. PATENT DOCUMENTS

| | | | | |
|---|---|---|---|---|
| 2011/0234561 | A1* | 9/2011 | Tzeng | G09G 3/3614 345/209 |
| 2015/0255028 | A1* | 9/2015 | Suyama | G09G 3/3611 345/98 |
| 2015/0255040 | A1* | 9/2015 | Inada | G09G 3/3611 345/690 |
| 2015/0287372 | A1* | 10/2015 | Suyama | G09G 3/3611 345/87 |
| 2016/0293126 | A1* | 10/2016 | Uemura | G09G 3/3677 |
| 2016/0365049 | A1* | 12/2016 | Uemura | G09G 3/3614 |

* cited by examiner

Fig.3

| Frame | 0 | 1 | 2 | 3 | 4 | 5 |
|---|---|---|---|---|---|---|
| REQOUT | | | | | | |
| DATA | | | | | | A |
| REF/NREF | N | N | N | N | N | R |
| Driving | | | | | | C |

Fig.4

| Frame | 0 | 1 | 2 | 3 | 4 | 5 | 6 | 7 | 8 | 9 | 10 |
|---|---|---|---|---|---|---|---|---|---|---|---|
| REQOUT | | | | | | | | | | RO | |
| DATA | A | | | | | | | | | | A |
| REF/NREF | R | N | N | N | N | N | N | N | N | N | R |
| Driving | D | | | | | | | | | | C |

Fig.5

| Frame | 0 | 1 | 2 | 3 | 4 | 5 | 6 | 7 | 8 | 9 | 10 |
|---|---|---|---|---|---|---|---|---|---|---|---|
| REQOUT | | | | | | | RO | RO | | | |
| DATA | | | | A | | | | A | A | | |
| REF/NREF | N | N | N | R | N | N | N | R | R | N | N |
| Driving | | | | C | | | | D | D | | |

Fig.6

| Frame | 0 | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| REQOUT | | | | | | | | | | RO | | | | RO | RO | | | |
| DATA | A | | | | | | | | | | A | | | | A | A | | |
| REF/NREF | R | N | N | N | N | N | N | N | N | N | R | N | N | N | R | R | N | N |
| Driving | D | | | | | | | | | | C | | | | D | D | | |

Fig.7

| Frame | 0 | 1 | 2 | 3 | 4 | 5 | 6 | 7 | 8 | 9 | 10 |
|---|---|---|---|---|---|---|---|---|---|---|---|
| REQOUT | | | | | | | RO | RO | | | |
| DATA | | A | | B | | | | B | B | | |
| REF/NREF | N | R | N | R | N | N | N | R | R | N | N |
| Driving | | C | | C | | | | D | D | | |

Fig.8

| Frame | 0 | 1 | 2 | 3 | 4 | 5 | 6 | 7 | 8 | 9 | 10 |
|---|---|---|---|---|---|---|---|---|---|---|---|
| REQOUT | | | | | | | RO | RO | | | |
| DATA | | | A | B | | | | B | B | | |
| REF/NREF | N | N | R | R | N | N | N | R | R | N | N |
| Driving | | | C | C | | | | D | D | | |

Fig.9

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| REQOUT | | | | RO | RO | | | | | | | RO | RO | | | | | | | | | | RO | RO | | | | | | |
| DATA | A | | | | A | A | | | A | | | | A | A | | | | | | A | | | | A | A | | | | | |
| REF/NREF | R | N | N | N | R | R | N | N | R | N | N | N | R | R | N | N | N | N | N | R | N | N | N | R | R | N | N | N | N | N |
| Driving | C | | | | D | D | | | C | | | | D | D | | | | | | C | | | | D | D | | | | | |
| VCOM | VCOM2 | | | | VCOM1 | | | | VCOM2 | | | | VCOM1 | | | | | | | VCOM2 | | | | VCOM1 | | | | | | |
| NREF_Cnt | | 1 | 2 | 3 | | | 1 | 2 | | 1 | 2 | 3 | | | 1 | 2 | 3 | 4 | 5 | | 1 | 2 | 3 | | | 1 | 2 | 3 | 4 | 5 |
| REF_Cnt | 1 | | | | 2 | 3 | | | 1 | | | | 2 | 3 | | | | | | 1 | | | | 2 | 3 | | | | | |

| Frame | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 |
|---|---|---|---|---|---|---|---|---|---|---|---|---|---|---|---|---|---|---|---|---|---|---|---|---|---|---|---|---|---|---|
| REQOUT | | | | | RO | RO | | | | | | RO | RO | | | | | | RO | RO | | | | | | | | | | RO |
| DATA | | A | | | | A | A | | B | | | | B | B | | C | | | | C | C | | | | | | | | | |
| REF/NREF | N | R | N | N | N | R | R | N | R | N | N | N | R | R | N | R | N | N | N | R | R | N | N | N | N | N | N | N | N | N |
| Driving | | C | | | | D | D | | C | | | | D | D | | C | | | | D | D | | | | | | | | | |
| VCOM | | VCOM2 | | | | VCOM1 | | | VCOM2 | | | | VCOM1 | | | VCOM2 | | | | VCOM1 | | | | | | | | | | |
| NREF_Cnt | 6 | | 1 | 2 | 3 | | | 1 | | 1 | 2 | 3 | | | 1 | | 1 | 2 | 3 | | | 1 | 2 | 3 | 4 | 5 | 6 | 7 | 8 | 9 |
| REF_Cnt | | 1 | | | | 2 | 3 | | 1 | | | | 2 | 3 | | 1 | | | | 2 | 3 | | | | | | | | | |

Fig.10

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| REQOUT | | | | | | | | | | | | | | | | | | | RO | RO | | | | | | | | | | RO |
| DATA | A | | A | | | A | | | B | | | B | | B | | B | | | | B | B | | | | | | | | | |
| REF/NREF | R | N | R | N | N | R | N | N | R | N | N | R | N | R | N | R | N | N | N | R | R | N | N | N | N | N | N | N | N | N |
| Driving | C | | C | | | C | | | C | | | C | | C | | C | | | | D | D | | | | | | | | | |
| VCOM | VCOM2 | | | | | | | | | | | | | | | | | | | VCOM1 | | | | | | | | | | |
| NREF_Cnt | | 1 | | 2 | 3 | | 1 | 2 | | 1 | 2 | | 1 | | 1 | | 1 | 2 | 3 | | | 1 | 2 | 3 | 4 | 5 | 6 | 7 | 8 | 9 |
| REF_Cnt | 1 | | 1 | | | 1 | | | 1 | | | 1 | | 1 | | 1 | | | | 2 | 3 | | | | | | | | | |

| Frame | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 |
|---|---|---|---|---|---|---|---|---|---|---|---|---|---|---|---|---|---|---|---|---|---|---|---|---|---|---|---|---|---|---|
| REQOUT | | | | RO | RO | | | | | | | | | | RO | | | | | RO | RO | | | | | | | | | |
| DATA | B | | | B | B | | | | | | | | | | | C | D | | | | D | D | | | | | | | | |
| REF/NREF | R | N | N | N | R | R | N | N | N | N | N | N | N | N | N | R | R | N | N | N | R | R | N | N | N | N | N | N | N | N |
| Driving | C | | | | D | D | | | | | | | | | | C | C | | | | D | D | | | | | | | | |
| VCOM | | | | | VCOM1 | | | | | | | | | | | VCOM2 | | | | | VCOM1 | | | | | | | | | |
| NREF_Cnt | | 1 | 2 | 3 | | | 1 | 2 | 3 | 4 | 5 | 6 | 7 | 8 | 9 | | | 1 | 2 | 3 | | | 1 | 2 | 3 | 4 | 5 | 6 | 7 | 8 |
| REF_Cnt | 1 | | | | 2 | 3 | | | | | | | | | | 1 | 1 | | | | 2 | 3 | | | | | | | | |

Fig.11

| Frame | 0 | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| REQOUT | | | | | | | | | | RO | | | | | | | | |
| DATA | A | | | | | | | | | | A | | | | | | | |
| REF/NREF | R | N | N | N | N | N | N | N | N | N | R | N | N | N | N | N | N | N |
| Driving | D | | | | | | | | | | D | | | | | | | |

Fig.12

| Frame | 0 | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| REQOUT | | | | | | | | | | RO | | | | RO | RO | | | |
| DATA | A | | | | | | | | | | B | | | | B | B | | |
| REF/NREF | R | N | N | N | N | N | N | N | N | N | R | N | N | N | R | R | N | N |
| Driving | D | | | | | | | | | | D | | | | D | D | | |

LIQUID CRYSTAL DISPLAY DEVICE AND METHOD FOR DRIVING SAME

TECHNICAL FIELD

The present invention relates to a liquid crystal display device, and specifically relates to a liquid crystal display device which performs pause driving (low-frequency driving), and a method for driving same.

BACKGROUND ART

There has hitherto been known an active matrix-type liquid crystal display device provided with a TFT (thin film transistor) as a switching element. This liquid crystal display device is provided with a liquid crystal panel configured of two insulating substrates opposed to each other. The one substrate of the liquid crystal panel is provided with gate bus lines (scanning signal lines) and source bus lines (video signal lines) in a matrix form, and is provided with TFTs in the vicinity of intersections between the gate bus lines and the source bus lines. Each TFT is configured of a gate electrode connected to the gate bus line, a source electrode connected to the source bus line, and a drain electrode. The drain electrode of each TFT is connected to one of a plurality of pixel electrodes that are arranged in a matrix form on the substrate so as to form an image. The other substrate of the liquid crystal panel is provided with a common electrode for applying a voltage between the common electrode and the pixel electrodes through a liquid crystal layer. In such a configuration, based on a video signal that the source electrode of each TFT receives from the source bus line when the gate electrode of this TFT receives an active scanning signal from the gate bus line, a voltage is applied between the pixel electrode and the common electrode. This drives the liquid crystal, and a desired image is displayed on a display portion of the liquid crystal panel.

Incidentally, the liquid crystal has a property that it deteriorates when a DC voltage continues to be applied.

Accordingly, in the liquid crystal display device, AC driving to reverse polarities of pixel voltages (voltages between the pixel electrodes and the common electrode) has been performed in order to suppress deterioration in liquid crystal. As an AC driving technique, a driving technique called frame-reversal driving is known in which the polarities of the pixel voltages are reversed with respect to each frame in a state where the polarities of the pixel voltages in all the pixels are made the same. It is to be noted that the driving technique of reversing the polarities of the pixel voltages with respect to each predetermined period will be hereinafter referred to as a "reversal driving technique". However, by the frame-reversal driving, flicker is relatively apt to occur at the time of image display. Hence there have hitherto been employed reversal driving techniques of a variety of polarity reversal patterns in order to suppress occurrence of flicker. As the reversal driving technique, column-reversal driving and dot-reversal driving are typically known.

The column-reversal driving is a driving technique of reversing the polarities of the pixel voltages with respect to each frame and each predetermined number of source bus lines. According to the column-reversal driving, the polarities of pixel voltages are reversed with respect to each predetermined number of source bus lines, and hence the frequency of spatial polarity reversal of a liquid crystal applied voltage becomes high as compared to the frame-reversal driving. For example, when the polarities of the pixel voltages are reversed with respect to each one frame and each one source bus line, polarities of pixel voltages in pixels on four rows and four columns in a certain frame become those as shown in FIG. 13. It is to be noted that in the next frame, the polarities of the pixel voltages are reversed in all the pixels.

The dot-reversal driving is a driving technique of reversing the polarities of the pixel voltages with respect to each one frame and also reversing the polarities in the pixels adjacent in a vertical or horizontal direction. In this driving technique, polarities of pixel voltages in pixels on four rows and four columns in a certain frame become those as shown in FIG. 14. It is to be noted that in the next frame, the polarities of the pixel voltages are reversed in all the pixels. According to this dot-reversal driving, the frequency of spatial polarity reversal of the liquid crystal applied voltage becomes still higher as compared to the column-reversal driving. That is, according to the dot-reversal driving, the polarity reversal pattern becomes complex as compared to the line-reversal driving and the column-reversal driving, thereby effectively suppressing occurrence of flicker. It should be noted that a driving technique of reversing the polarities of the pixel voltages with respect to each predetermined number of gate bus lines in the vertical direction is called "multi-dot-reversal driving". For example, a driving technique of reversing the polarities of the pixel voltages with respect to each two gate bus lines in the vertical direction as shown in FIG. 15 is called "two-dot-reversal driving".

In general, when a polarity reversal pattern in an employed reversal driving technique is complex, flicker hardly occurs, but power consumption becomes large. On the other hand, when a polarity reversal pattern in an employed reversal driving technique is simple, power consumption becomes small, but flicker is apt to occur. There has thus been required a technique for reducing power consumption while suppressing occurrence of flicker. For example, according to a liquid crystal display device disclosed in Japanese Patent Application Laid-Open No. 2005-215591, the dot-reversal driving and the column-reversal driving are switched in accordance with a frequency of an input video signal. Further, according to a liquid crystal display device disclosed in Japanese Patent Application Laid-Open No. 2003-337577, two-dot-reversal driving and one-dot-reversal driving are switched in accordance with a vertical frequency.

PRIOR ART DOCUMENTS

Patent Documents

[Patent Document 1] Japanese Patent Application Laid-Open No. 2005-215591

[Patent Document 2] Japanese Patent Application Laid-Open No. 2003-337577

SUMMARY OF THE INVENTION

Problems to be Solved by the Invention

In recent years, concerning the liquid crystal display device, there has been progress in the development of a driving method where "a pause frame (pause period) for suspending a writing operation by bringing all gate bus lines into a non-scanning state is provided between a refresh frame (writing period) and a refresh frame (writing period)". Here, the refresh frame means a frame for charging a pixel capacitance in the display portion based on an image signal for one frame (for one screen). The driving method where the pause frame for suspending a writing operation is provided in this manner is called "pause driving", "low-frequency driving", and the like. In a liquid crystal display device to which the pause driving is employed, there is no need for giving a controlling signal or the like to a liquid crystal driving circuit (gate driver and source driver) in the pause frame. This leads to reduction in driving frequency of the liquid crystal driving circuit as a whole, thus allowing low power consumption. FIG. 16 is a diagram for explaining one example of the pause driving. In the example shown in FIG. 16, a refresh frame for one frame (one frame period is 16.67 ms) of a general liquid crystal display device with a refresh rate (driving frequency) of 60 Hz and pause frames for 59 frames alternately appear. Such pause driving is preferable for still image display.

As described above, when the pause driving is employed, low power consumption can be realized. However, in the pause driving, flicker is apt to be visually recognized when the refresh rate is low. Therefore, the pause driving also requires a technique for reducing power consumption while suppressing occurrence of flicker. With regard to this, even when the technique disclosed in Japanese Patent Application Laid-Open No. 2005-215591 is employed, a more preferable reversal driving technique is not decided in accordance with a frequency of an input video signal in the pause driving, and hence a desired effect cannot be obtained. Further, even when the technique disclosed in Japanese Patent Application Laid-Open No. 2003-337577 is employed, the frequency of refreshes has a larger influence on occurrence of flicker than the vertical frequency in the pause driving, and hence a desired effect cannot be obtained.

Accordingly, an object of the present invention is to effectively suppress occurrence of flicker while suppressing an increase in power consumption in a liquid crystal display device for performing pause driving.

Means for Solving the Problems

A first aspect of the present invention is directed to a liquid crystal display device, which employs pause driving to provide a pause frame for suspending a refresh of a screen between two refresh frames for performing a refresh of the screen, and performs image display by applying an AC voltage to liquid crystal based on an image signal irregularly inputted from an external portion, the liquid crystal display device comprising:

a liquid crystal panel that includes a plurality of pixel electrodes arranged in a matrix form and a common electrode provided for applying a voltage between the common electrode and the plurality of pixel electrodes through the liquid crystal, and displays an image based on the image signal;

a liquid crystal panel driving portion that drives the liquid crystal panel; and a reversal driving control portion that receives the image signal, decides which of a refresh frame or a pause frame each frame is set to, and decides a reversal driving technique for applying an AC voltage to the liquid crystal to be either a first reversal driving technique where the frequency of the spatial polarity reversal of the voltage applied to liquid crystal is relatively low or a second reversal driving technique where the frequency of the spatial polarity reversal of the voltage applied to the liquid crystal is relatively high, to control an operation of the liquid crystal panel driving portion, wherein, when a frame in which the image signal is inputted from the external portion without requesting the external portion to input the image signal is defined as a first input frame, the reversal driving control portion sets the reversal driving technique in the first input frame to the first reversal driving technique while setting the first input frame to a refresh frame that is defined as a first refresh frame, sets n (n is an integer not smaller than 1) frames subsequent to the first refresh frame to pause frames, sets a frame subsequent to the final pause frame to a refresh frame that is defined as a second refresh frame, and sets the reversal driving technique in the second refresh frame to the second reversal driving technique.

According to a second aspect of the present invention, in the first aspect of the present invention, the reversal driving control portion requests the external portion to input the image signal when the image signal is not inputted over a period corresponding to a previously set number of frames.

According to a third aspect of the present invention, in the second aspect of the present invention, when a frame in which the image signal is inputted from the external portion by requesting the external portion to input the image signal is defined as a second input frame, the reversal driving control portion sets the second input frame to a refresh frame that is defined as the first refresh frame in addition to the first input frame, and sets the reversal driving technique in the second input frame to the first reversal driving technique.

According to a fourth aspect of the present invention, in the second aspect of the present invention, when a frame in which the image signal is inputted from the external portion by requesting the external portion to input the image signal is defined as a second input frame, the reversal driving control portion sets the second input frame to a refresh frame, and sets the reversal driving technique in the second input frame to the second reversal driving technique.

According to a fifth aspect of the present invention, in the fourth aspect of the present invention, when an image based on the image signal changes in the second input frame as compared to the previous refresh frame, the reversal driving control portion sets the second input frame to a refresh frame that is defined as the first refresh frame in addition to the first input frame.

According to a sixth aspect of the present invention, in the first aspect of the present invention, the second refresh frame is made up of a plurality of frames.

According to a seventh aspect of the present invention, in the first aspect of the present invention, the first reversal driving technique is a column-reversal driving technique, and the second reversal driving technique is a dot-reversal driving technique.

According to an eighth aspect of the present invention, in the first aspect of the present invention, a potential of the common electrode is set to a value that is different between at the time when the liquid crystal panel is driven by the first reversal driving technique and at the time when the liquid crystal panel is driven by the second reversal driving technique.

According to a ninth aspect of the present invention, in the first aspect of the present invention, the liquid crystal panel includes a scanning signal line, a video signal line which is applied with a video signal in accordance with the image signal, and a thin film transistor where a control terminal is connected to the scanning signal line, a first conduction terminal is connected to the video signal line, a second conduction terminal is connected to the pixel electrode, and a channel layer is formed of an oxide semiconductor.

According to a tenth aspect of the present invention, in the ninth aspect of the present invention, the oxide semiconductor is indium gallium zinc oxide mainly composed of indium (In), gallium (Ga), zinc (Zn), and oxygen (O).

An eleventh aspect of the present invention is directed to a driving method of a liquid crystal display device, which employs pause driving to provide a pause frame for suspending a refresh of a screen between two refresh frames for performing a refresh of the screen and performs image display by applying an AC voltage to liquid crystal based on an image signal irregularly inputted from an external portion, the driving method comprising:

a liquid crystal panel driving step of driving a liquid crystal panel that includes a plurality of pixel electrodes arranged in a matrix form and a common electrode provided for applying a voltage between the common electrode and the plurality of pixel electrodes through the liquid crystal, and displays an image based on the image signal; and a reversal driving control step of receiving the image signal, deciding which of a refresh frame or a pause frame each frame is set to, and deciding a reversal driving technique for applying an AC voltage to the liquid crystal to be either a first reversal driving technique where the frequency of the spatial polarity reversal of the voltage applied to the liquid crystal is relatively low or a second reversal driving technique where the frequency of the spatial polarity reversal of the voltage applied to the liquid crystal is relatively high, to control an operation in the liquid crystal panel driving step, wherein, when a frame in which the image signal is inputted from the external portion without requesting the external portion to input the image signal is defined as a first input frame, in the reversal driving control step, the first input frame is set to a refresh frame that is defined as a first refresh frame, and the reversal driving technique in the first input frame is set to the first reversal driving technique, n (n is an integer not smaller than 1) frames subsequent to the first refresh frame are set to pause frames, a frame subsequent to the final pause frame is set to a refresh frame that is defined as a second refresh frame, and the reversal driving technique in the second refresh frame is set to the second reversal driving technique.

Effects of the Invention

According to the first aspect of the present invention, when an image signal is inputted from the external portion without requesting the external portion to input the image signal, there is performed a refresh by the first reversal driving technique with a relatively low frequency of spatial polarity reversal of the liquid crystal applied voltage. After a frame in which the refresh by the first reversal driving technique has been performed, a refresh frame (second refresh frame), in which the reversal driving technique is the second reversal driving technique with a relatively high frequency of spatial polarity reversal of the liquid crystal applied voltage, is provided with several pause frames put between the refresh frames. Here, when the image signal is frequently inputted (when the image signal is inputted again after input of the image signal and before appearance of the second refresh frame), a refresh by the second reversal driving technique is not performed, and only a refresh by the first reversal driving technique is performed. In contrast, when the frequency of input of the image signal is low, both the refresh by the first reversal driving technique and the refresh by the second reversal driving technique are performed. When a refresh is frequently performed, flicker is hardly visually recognized, and hence the display quality does not deteriorate even when the first reversal driving technique with a relatively low frequency of spatial polarity reversal of the liquid crystal applied voltage is employed. Instead there is obtained a power consumption reducing effect by employing such a reversal driving technique. Further, because a refresh by the second reversal driving technique with a relatively high frequency of the spatial polarity reversal of the liquid crystal applied voltage is inserted when the frequency of input of the image signal is low, deterioration in display quality due to flicker can be suppressed. From the above, according to the present embodiment, in the liquid crystal display device which performs the pause driving, it is possible to effectively suppress occurrence of flicker while suppressing an increase in power consumption.

According to the second aspect of the present invention, deterioration in pixel voltage due to performance of no refresh for a long period is prevented.

According to the third aspect of the present invention, even when the image signal is inputted by requesting the external portion to input the image signal, the refresh by the first reversal driving technique is performed. Then, the refresh by the second reversal driving technique is performed with several pause frames put between the refreshes. Therefore, even when the frequency of input of the image signal is extremely low, both the refresh by the first reversal driving technique and the refresh by the second reversal driving technique are performed. Thereby, similarly to the first aspect of the present invention, in the liquid crystal display device which performs the pause driving, it is possible to effectively suppress occurrence of flicker while suppressing an increase in power consumption.

According to the fourth aspect of the present invention, when the image signal is inputted by requesting the external portion to input the image signal, the refresh by the second reversal driving technique is performed. Therefore, when the image signal is not inputted for a long period, the refresh by the second reversal driving technique with a relatively high frequency of spatial polarity reversal of the liquid crystal applied voltage is performed. Accordingly, occurrence of flicker at the time of no image signal being inputted for a long period is effectively suppressed.

According to the fifth aspect of the present invention, at the time of the image signal being inputted by requesting the external portion to input the image signal, when the image changes, the refresh by the second reversal driving technique is performed with several pause frames put between the refreshes. Therefore, when the image changes after the state where the image signal is not inputted continues for a long time, a plurality of times of writing (charging) into the pixel capacitance are performed. Hence the pixel voltage reliably reaches a target voltage in each pixel, thereby preventing deterioration in display quality.

According to the sixth aspect of the present invention, the second refresh frame is made up of two frames. This suppresses occurrence of screen burn-in caused by deviation of the polarity of the pixel voltage in each pixel.

According to the seventh aspect of the present invention, the reversal driving technique is switched between the column-reversal driving technique where power consumption is low and the dot-reversal driving technique where flicker is hardly visually recognized, whereby it is possible to reliably achieve the effect of the first aspect of the present invention.

According to the eighth aspect of the present invention, even when the optimum common electrode potential is different between at the time when the liquid crystal panel is driven by the first reversal driving technique and at the time when the liquid crystal panel is driven by the second reversal driving technique, it is possible to suppress deterioration in liquid crystal.

According to the ninth aspect of the present invention, a thin film transistor where a channel layer is formed of an oxide semiconductor is used as the thin film transistor provided in the liquid crystal panel. Therefore, a voltage written into the capacitance (pixel capacitance) between the pixel electrode and the common electrode is held over a long time. Hence it is possible to lower the frequency of refreshes when the image signal is not inputted from the external portion, without causing deterioration in display quality. From the above, in the liquid crystal display device for performing the pause driving, it is possible to significantly reduce power consumption while suppressing occurrence of flicker.

According to the tenth aspect of the present invention, by using indium gallium zinc oxide as the oxide semiconductor that forms the channel layer, it is possible to reliably achieve the effect of the ninth aspect of the present invention.

According to the eleventh aspect of the present invention, a similar effect to that of the first aspect of the present invention can be obtained in the method for driving the liquid crystal display device.

BRIEF DESCRIPTION OF THE DRAWINGS

FIG. 3 is a diagram for explaining a method for deciding a refresh frame and a method for deciding a reversal driving technique in the above embodiment.

FIG. 4 is a diagram for explaining the method for deciding a refresh frame and the method for deciding a reversal driving technique in the above embodiment.

FIG. 5 is a diagram for explaining the method for deciding a refresh frame and the method for deciding a reversal driving technique in the above embodiment.

FIG. 6 is a diagram for explaining the method for deciding a refresh frame and the method for deciding a reversal driving technique in the above embodiment.

FIG. 7 is a diagram for explaining the method for deciding a refresh frame and the method for deciding a reversal driving technique in the above embodiment.

FIG. 8 is a diagram for explaining the method for deciding a refresh frame and the method for deciding a reversal driving technique in the above embodiment.

FIG. 9 is a diagram for explaining a concrete example (first concrete example) of the driving in the above embodiment.

FIG. 10 is a diagram for explaining a concrete example (second concrete example) of the driving in the above embodiment.

FIG. 11 is a diagram for explaining a method for deciding a refresh frame and a method for deciding a reversal driving technique in a first modified example of the above embodiment.

FIG. 12 is a diagram for explaining the method for deciding a refresh frame and the method for deciding a reversal driving technique in the first modified example of the above embodiment.

MODE FOR CARRYING OUT THE INVENTION

Hereinafter, one embodiment of the present invention will be described with reference to attached drawings. It is to be noted that in the present specification, charging of a pixel capacitance in a display portion based on an image signal for one frame regardless of the presence or absence of an image change is referred to as "refresh".

<1. Whole Configuration and Summary of Operation>

Figure 2:
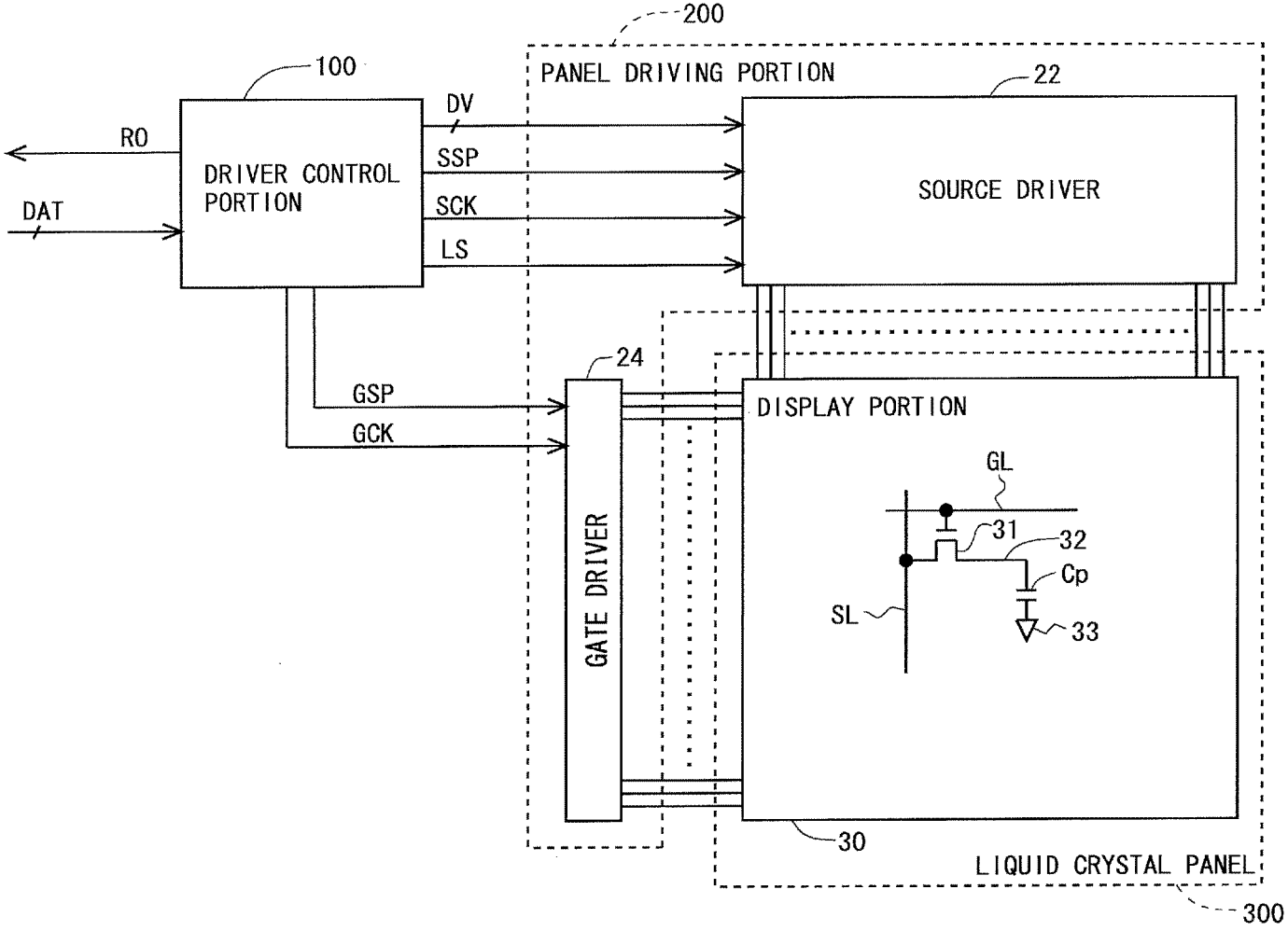
FIG. 2 is a block diagram showing a whole configuration of the liquid crystal display device in the above embodiment.

FIG. 2 is a block diagram showing a whole configuration of a liquid crystal display device according to one embodiment of the present invention. This liquid crystal display device is configured of a driver control portion 100, a panel driving portion 200, and a liquid crystal panel 300. The panel driving portion 200 includes a source driver (video signal line drive circuit) 22 and a gate driver (scanning signal line drive circuit) 24. The liquid crystal panel 300 includes a display portion 30. It is to be noted that a detailed configuration of the driver control portion 100 will be described later.

Figure 16:
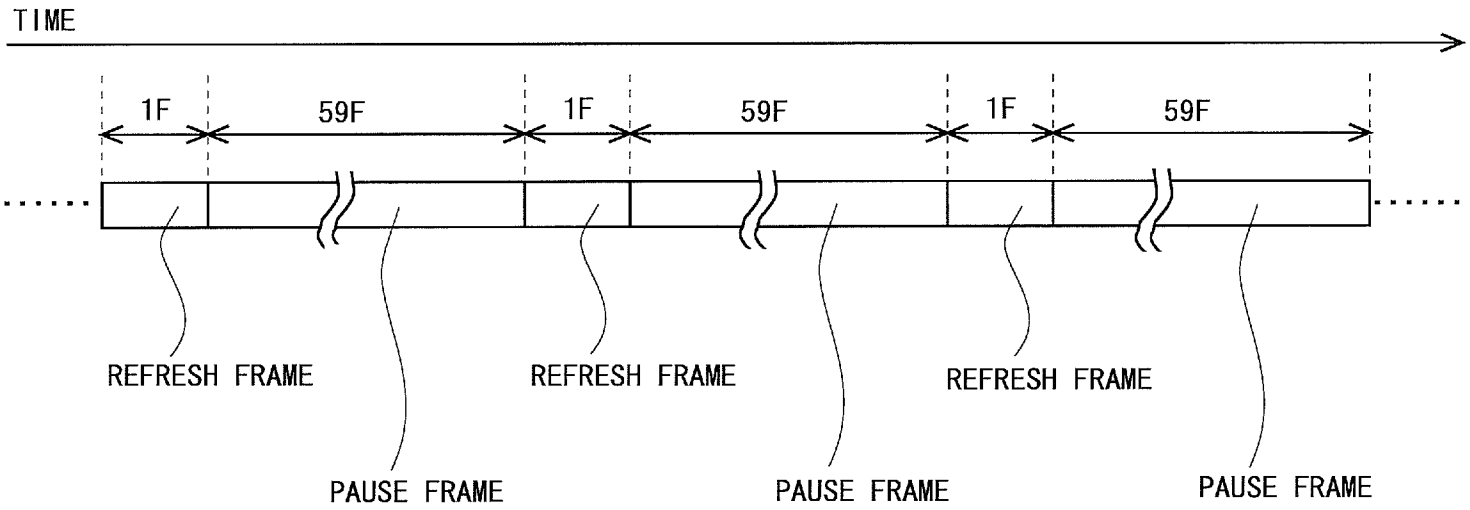
FIG. 16 is a diagram for explaining one example of low-frequency driving.

In the liquid crystal display device according to the present embodiment, pause driving (low-frequency driving) is performed (see FIG. 16). That is, several to several tens of pause frames are provided after a refresh frame for charging a pixel capacitance in a display portion 30. However, the number of pause frames that appear between two refresh frames is appropriately changed during operation of the liquid crystal display device.

Concerning FIG. 2, the display portion 30 is provided with a plurality of source bus lines (video signal lines) SL and a plurality of gate bus lines (scanning signal lines) GL. A pixel formation portion for forming a pixel is provided corresponding to each intersection of the source bus line SL and the gate bus line GL. That is, a plurality of pixel formation portions are included in the display portion 30. The above plurality of pixel formation portions are arranged in a matrix form to constitute a pixel array. Each pixel formation portion is configured of: a TFT (thin film transistor) 31 as a switching element whose gate terminal (control terminal) is connected to the gate bus line GL passing through the corresponding intersection and whose source terminal (first conduction terminal) is connected to the source bus line SL passing through that intersection; a pixel electrode 32 connected to a drain terminal (second conduction terminal) of the TFT 31; a common electrode 33 as a counter electrode for giving a common voltage to the plurality of pixel formation portions; and liquid crystal (liquid crystal layer) commonly provided in the plurality of pixel formation portions and placed between the pixel electrode 32 and the common electrode 33. A liquid crystal capacitance formed by the pixel electrode 32 and the common electrode 33 constitutes a pixel capacitance Cp. Generally, an auxiliary capacitance is provided in parallel to the liquid crystal capacitance so as to reliably hold a voltage in the pixel capacitance Cp, but a description and illustration of the auxiliary capacitance will be omitted since it is not directly related to the present invention. It is to be noted that only constitutional elements corresponding to one pixel formation portion are shown in the display portion 30 in FIG. 2. Further, the common electrode 33 is not necessarily required to be provided as opposed to the pixel electrode 32. That is, the present invention is also applicable to a liquid crystal display device that employs a lateral electric field mode (e.g., IPS mode) as a technique where the pixel electrode 32 and the common electrode 33 are provided on the same substrate to generate an electric field not in a vertical direction but in a lateral direction with respect to the surface of the substrate.

As described above, in the liquid crystal display device according to the present embodiment, the pause driving is performed. In the present embodiment, an oxide TFT (thin film transistor using an oxide semiconductor for a channel layer) is typically used as the TFT 31 in the pixel formation portion. More specifically, the channel layer of the TFT 31 is formed of InGaZnOx: indium gallium zinc oxide, mainly composed of indium (In), gallium (Ga), zinc (Zn), and oxygen (O). Hereinafter, a TFT using InGaZnOx for the channel layer will be referred to as an "IGZO-TFT". Incidentally, a thin film transistor using amorphous silicon or the like for the channel layer (hereinafter referred to as "silicon TFT") has a relatively large off-leak current. For this reason, in the case of using the silicon TFT as the TFT 31 in the pixel formation portion, an electric charge held in the pixel capacitance Cp leaks through the TFT 31, resulting in fluctuation in voltage that is to be held at the time of an off-state. In contrast, the IGZO-TFT has a far smaller off-leak current as compared to the silicon TFT. Hence it is possible to hold a voltage written into the pixel capacitance Cp (liquid crystal applied voltage) for a longer period. The IGZO-TFT is thus preferable for the case of performing the pause driving. It should be noted that a similar effect is obtained also in the case of using, for the channel layer, an oxide semiconductor containing at least one of indium, gallium, zinc, copper (Cu), silicon (Si), tin (Sn), aluminum (Al), calcium (Ca), germanium (Ge), and lead (Pb), for example. Further, using the oxide TFT as the TFT 31 in the pixel formation portion is a mere example, and in place of this, the silicon TFT or the like may be used.

Next, operations of the constitutional elements shown in FIG. 2 will be described. An image signal DAT is irregularly transmitted from an external portion (host) to this liquid crystal display device. The driver control portion 100 receives the image signal DAT, and outputs a digital video signal DV; a source start pulse signal SSP, a source clock signal SCK, and a latch strobe signal LS which are signals for controlling an operation of a source driver 22; and a gate start pulse signal GSP and a gate clock signal GCK which are signals for controlling an operation of a gate driver 24. Further, the driver control portion 100 outputs a signal (hereinafter referred to as "request signal") RO for requesting the external portion (host) to input the image signal DAT, as required. The source driver 22 applies a driving video signal to each source bus line SL based on the digital video signal DV, the source start pulse signal SSP, the source clock signal SCK, and the latch strobe signal LS which are outputted from the driver control portion 100. The gate driver 24 applies a scanning signal to each gate bus line GL based on the gate start pulse signal GSP and the gate clock signal GCK which are outputted from the driver control portion 100.

Accordingly, the plurality of gate bus lines GL are selectively driven one by one.

In such a manner as above, by the driving video signal being applied to each source bus line SL and the scanning signal being applied to each gate bus line GL, an image based on the image signal DAT is displayed on the display portion 30 of the liquid crystal panel 300.

As described above, the image signal DAT is irregularly transmitted from the external portion (host) to this liquid crystal display device. With regard to this, a frame in which the image signal DAT has been inputted from the external portion (host) without outputting a request signal RO to the external portion (host) will be hereinafter referred to as a "first input frame". Further, a frame in which the image signal DAT has been inputted from the external portion by outputting the request signal RO to the external portion (host) will be hereinafter referred to as a "second input frame". It is to be noted that the reason why the configuration has been formed so as to irregularly transmit the image signal DAT is because the image signal DAT is not necessarily required to be inputted in all frames in the liquid crystal display device that employs the pause driving.

<2. Configuration and Operation of Driver Control Portion>

Figure 1:
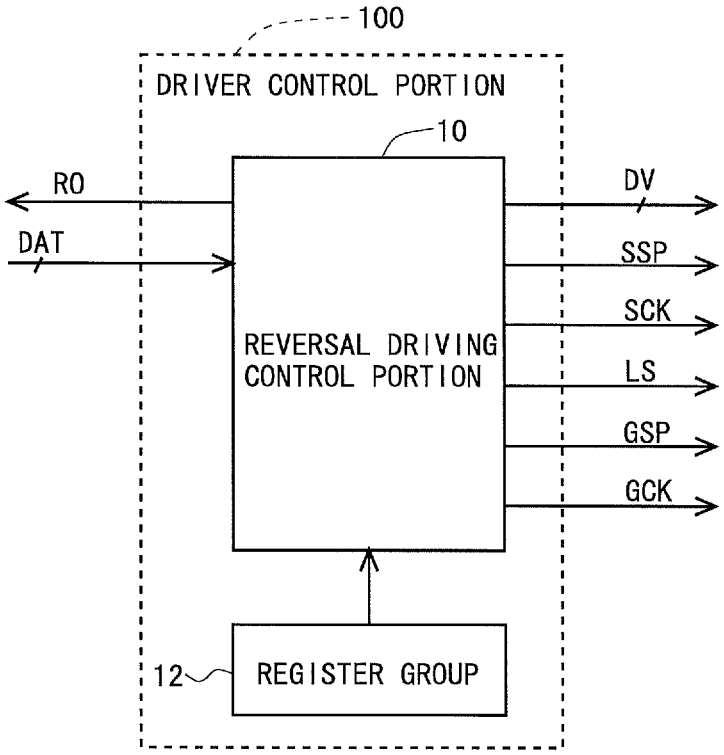
FIG. 1 is a block diagram showing a configuration of a driver control portion in a liquid crystal display device according to one embodiment of the present invention.

Next, a description will be given of a configuration and an operation of the driver control portion 100 in the present embodiment. FIG. 1 is a block diagram showing a configuration of the driver control portion 100 in the present embodiment. The driver control portion 100 includes a reversal driving control portion 10 and a register group 12.

The reversal driving control portion 10 receives the image signal DAT and decides which of a refresh frame or a pause frame each frame is set to, and also decides the reversal driving technique for applying an AC voltage to the liquid crystal. Then, in the frame that is set to the refresh frame, the reversal driving control portion 10 outputs the digital video signal DV based on the image signal DAT, and also outputs the source start pulse signal SSP, the source clock signal SCK, the latch strobe signal LS, the gate start pulse signal GSP, and the gate clock signal GCK such that the liquid crystal panel 300 is driven in accordance with the decided reversal driving technique. Further, the reversal driving control portion 10 outputs the request signal RO to the external portion (host) as required. A variety of set values concerning the decision of the refresh frame and the decision of the reversal driving technique are stored in the register group 12, and those set values are referred to by the reversal driving control portion 10.

In the present embodiment, it is assumed that the register group includes four registers having register names of "REF", "NREF", "REFINT", and "REFDET". What each register serves for will be described later. Further, it is assumed that values of the above four registers are set as follows.

REF=1
NREF=9
REFINT=3
REFDET=3

Figure 13:
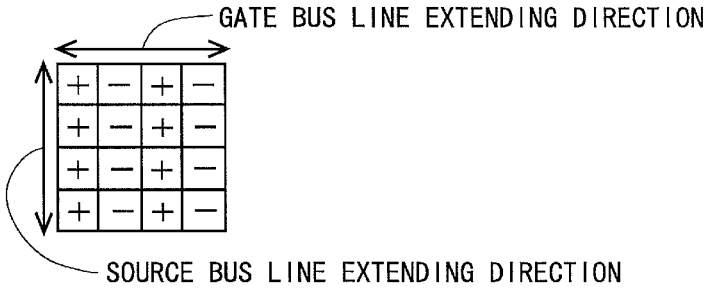
Fig.13 PRIOR ART
FIG. 13 is a diagram showing a polarity reversal pattern of column-reversal driving.
Figure 14:
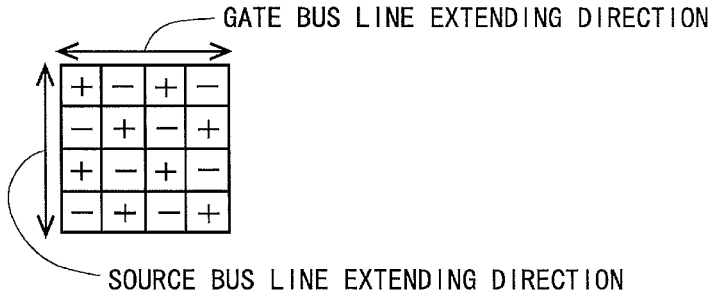
Fig.14 PRIOR ART
FIG. 14 is a diagram showing a polarity reversal pattern of dot-reversal driving.
Figure 15:
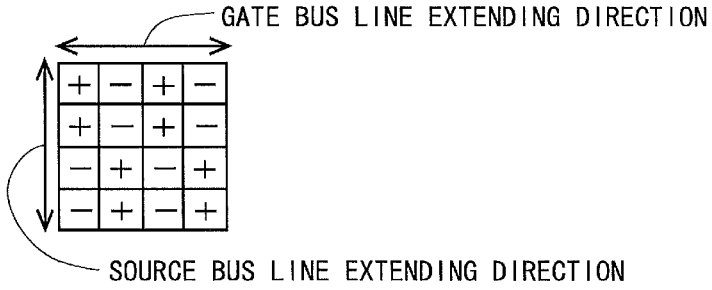
Fig.15 PRIOR ART
FIG. 15 is a diagram showing a polarity reversal pattern of two-dot-reversal driving.

It is to be noted that in the present embodiment, either column-reversal driving (see FIG. 13) or dot-reversal driving (see FIG. 14) is employed as the reversal driving technique in each refresh frame. With regard to this, as grasped from FIGS. 13 and 14, the frequency of the spatial polarity reversal of the liquid crystal applied voltage is higher in the dot-reversal driving than in the column-reversal driving. That is, in the present embodiment, the column-reversal driving corresponds to the first reversal driving technique with a relatively low frequency of spatial polarity reversal of the liquid crystal applied voltage, and the dot-reversal driving corresponds to the second reversal driving technique with a relatively high frequency of spatial polarity reversal of the liquid crystal applied voltage.

<3. Method for Deciding Refresh Frame and Method for Deciding Reversal Driving Technique>

Next, with reference to FIGS. 3 to 8, a description will be given of a method for deciding which of a refresh frame or a pause frame each frame is set to, and a method for deciding the reversal driving technique. First, a description concerning FIGS. 3 to 8 will be given below. A number in a "Frame" field shows frame number when it is assumed that a certain frame is "zero-th" frame. A "REQOUT" field shows the presence or absence of output of the request signal RO in each frame. "RO" represents outputting the request signal RO. In a "DATA" field, there is put an alphabet for specifying an image in each frame based on the image signal DAT transmitted from the external portion. That is, a change in alphabet in the "DATA" field shows a change in image. Further, a frame inputted with an alphabet shows that it is a frame in which the image signal DAT has been inputted. A "REF/NREF" field shows which of a refresh frame or a pause frame each frame is. "R" represents a refresh frame, and "N" represents a pause frame. A "Driving" field shows the reversal driving technique in the refresh frame. "C" represents the column-reversal driving, and "D" represents the dot-reversal driving.

In the present embodiment, the first input frame (frame in which the image signal DAT is inputted from the external portion without outputting the request signal RO) is set to a refresh frame. Further, regardless of the presence or absence of an image change and the number of times of pause frames after performance of the previous refresh, the reversal driving technique in the first input frame is set to the column-reversal driving. It is to be noted that, in the reversal driving control portion 10, for example, when a vertical synchronization signal is detected, it is determined that the image signal DAT has been inputted. For example, when an image signal DAT is inputted in the fifth frame on the assumption that a certain frame is taken as the zero-th frame, the fifth frame is set as a refresh frame, and the reversal driving technique in the fifth frame is set to the column-reversal driving, as shown in FIG. 3.

Incidentally, when the number of times (nine times in the present embodiment) of pause frames set by the register NREF are generated after the previous refresh frame without input of the image signal DAT, the request signal RO is outputted to the external portion (host) such that the image signal DAT is inputted in the next frame after the final pause frame. In the present embodiment, when the previous refresh frame is taken as zero-th frame, the request signal RO is outputted in the ninth frame, as shown in FIG. 4. Thereby, the image signal DAT is inputted from the external portion in the tenth frame. That is, the tenth frame becomes the second input frame (a frame in which the image signal DAT has been inputted from the external portion by output of the request signal RO to the external portion). The tenth frame is set to a refresh frame, and the reversal driving technique in the tenth frame is set to the column-reversal driving (see FIG. 4). It is to be noted that, after the final pause frame, the refresh frame continues just the number of times set by the register REF (once in the present embodiment). In such a manner, the register REF serves to hold the number of times of refresh frames that continues after the final pause frame in the case where the number of times of pause frames set by the register NREF are generated since the previous refresh frame. The register NREF serves to hold the number of times of continuation of pause frames, in the number of times of continuation the request signal RO is to be outputted.

Further, in the present embodiment, a refresh is also performed after the first input frame as described later, and hence the first input frame is defined as the first refresh frame. The number of times (three times in the present embodiment) of frames set by the register REFINT, which follow the first refresh frame, are set as pause frames. Then, one or a plurality of frames subsequent to the final pause frame is set as a refresh frame (this refresh frame is defined as a second refresh frame). The number of second refresh frames is set such that a total of the number of first refresh frames (once in the present embodiment) and the number of second refresh frames becomes the number of times set by the register REFDET (three times in the present embodiment). The reversal driving technique in the second refresh frame is set to the dot-reversal driving. It is to be noted that in the second refresh frame, the image signal DAT is inputted from the external portion by the request signal RO being outputted in the previous frame. As grasped from the above, the register REFINT serves to hold the number of times of pause frames between the first refresh frame and the second refresh frame, and the register REFDET serves to hold a sum of the number of times of first refresh frames and second refresh frames.

For example, when an image signal DAT is inputted in the third frame on the assumption that a certain frame is taken as the zero-th frame, the fourth to sixth frames are set as pause frames, and the seventh and eighth frames are set as refresh frames (second refresh frames), as shown in FIG. 5. The reversal driving technique in each of the seventh frame and the eighth frame is set to the dot-reversal driving.

Further, in the present embodiment, a refresh is performed also after the second input frame. Therefore, the second input frame is also defined as the first refresh frame in addition to the first input frame. For example, when an image signal DAT is inputted from the external portion in the tenth frame by output of the request signal RO in the ninth frame on the assumption that the previous refresh frame is taken as the zero-th frame, the eleventh frame to the thirteenth frame are set as pause frames, and the fourteenth frame and the fifteenth frame are set as refresh frames (second refresh frames), as shown in FIG. 6. The reversal driving technique in each of the fourteenth frame and the fifteenth frame is set to the dot-reversal driving.

As described above, in the present embodiment, after the first refresh frame, three times of pause frames are generated, and then the second refresh frame is given. However, the image signal DAT may be inputted before generation of three times of pause frames. For example, it is assumed that a certain frame is taken as the zero-th frame, the image signal DAT is inputted in the first frame, and thereafter the image signal DAT is inputted also in the third frame. In this case, the third frame is set to a refresh frame, and the reversal driving technique in the third frame is set to the column-reversal driving (see FIG. 7). Then, the third frame is taken as the first refresh frame, and frames (the seventh and eighth frames here) after generation of three times of pause frames (the fourth to sixth frames here) are set as the second refresh frames (see FIG. 7). It is to be noted that, although the image has changed in the third frame in FIG. 7, the presence or absence of the change in image does not affect decision of the reversal driving technique.

Further, when a refresh by the column-reversal driving is performed consecutively in two frames (the second and third frames in FIG. 8), frames (seventh and eighth frames here) after generation of three times of pause frames since the latter refresh frame (the third frame here) are set as the second refresh frames.

<4. Concrete Example>

Next, with reference to FIGS. 9 and 10, a concrete example of the driving in the present embodiment will be described. It should be noted that, concerning FIGS. 9 and 10, the "Frame", "REQOUT", "DATA", "REF/NREF", and "Driving" fields show similar contents to those in FIGS. 3 to 8. A "VCOM" field represents a potential of the common electrode 33 in each frame. In the present embodiment, a potential of the common electrode 33 is set to either "VCOM1" or "VCOM2". "VCOM1" and "VCOM2" are different potentials. An "NREF_Cnt" field shows the frame number of each pause frame when it is assumed that the previous refresh frame is "zero-th" frame. A "REF_Cnt" field shows the refresh frame number of each refresh frame based on a set value of the register REF or a set value of the register REFDET.

<4.1 First Concrete Example>

A first concrete example will be described with reference to FIG. 9. The first frame is a refresh frame in which the reversal driving technique is the column-reversal driving. It should be noted that it is assumed that, concerning the first frame, the image signal DAT has been inputted without output of the request signal RO in the previous frame. Three frames (the second to fourth frames) subsequent to the first frame are pause frames in accordance with the set value of the register REFINT. Two frames (the fifth and sixth frames) subsequent thereto are refresh frames in accordance with the set value of the register REFDET. Because the fifth and sixth frames become the second refresh frames, the reversal driving technique in each of the fifth and sixth frames is the dot-reversal driving. It is to be noted that the request signal RO for requesting to input the image signal DAT in the fifth and sixth frames is outputted in the fourth and fifth frames.

Thereafter, the image signal DAT is inputted in the ninth frame. Thereby, the ninth frame becomes a refresh frame in which the reversal driving technique is the column-reversal driving. Then, the tenth to twelfth frames become pause frames, and the thirteenth and fourteenth frames become refresh frames (second refresh frames) in which the reversal driving technique is the dot-reversal driving.

Thereafter, the image signal DAT is inputted in the twentieth frame, the thirty-second frame, the thirty-ninth frame, and the forty-sixth frame. Thereby, the refresh frame and the reversal driving technique are decided in a way similar to the time when the image signal DAT is inputted in the ninth frame. After performance of a refresh by the dot-reversal driving in the fifty-first frame, the number of times (nine times in the present embodiment) of pause frames (the fifty-second to sixtieth frames) set by the register NREF have been generated without input of the image signal DAT, and hence the request signal RO is outputted to the external portion (host) in the final pause frame (the sixtieth frame).

<4.2 Second Concrete Example>

A second concrete example will be described with reference to FIG. 10. The first frame is a refresh frame in which the reversal driving technique is the column-reversal driving. It should be noted that it is assumed that, concerning the first frame, the image signal DAT has been inputted without output of the request signal RO in the previous frame. Thereafter, the image signal DAT is inputted also in the third frame, the sixth frame, the ninth frame, the twelfth frame, the fourteenth frame, and the sixteenth frame. The image signal DAT has been inputted without generation of three times of pause frames since the previous refresh frame as thus described, and hence a refresh frame as the second refresh frame is not provided from the first frame to the sixteenth frame.

Thereafter, the twentieth frame and the twenty-first frame are made to be refresh frames as the second refresh frames. That is, the dot-reversal driving is performed in the twentieth frame and the twenty-first frame.

Thereafter, the number of times (nine times in the present embodiment) of pause frames (the twenty-second to thirtieth frames) set by the register NREF have been generated without input of the image signal DAT, and hence the request signal RO is outputted to the external portion (host) in the final pause frame (the thirtieth frame). Then, the image signal DAT is inputted from the external portion in the thirty-first frame. Thereby, the thirty-first frame becomes a refresh frame in which the reversal driving technique is the dot-reversal driving. Then, the thirty-second to thirty-fourth frames become pause frames, and the thirty-fifth and thirty-sixth frames become refresh frames (second refresh frames) where the reversal driving technique is the dot-reversal driving.

Thereafter, the number of times of pause frames (the thirty-seventh to forth-fifth frames) set by the register NREF have been generated without input of the image signal DAT, and hence the request signal RO is outputted to the external portion (host) in the final pause frame (the forty-fifth frame). Thereby, the forty-sixth frame becomes a refresh frame in which the reversal driving technique is the dot-reversal driving. Thereafter, the image signal DAT is inputted also in the forty-seventh frame, and the forty-seventh frame becomes a refresh frame in which the reversal driving technique is the dot-reversal driving. In such a manner, a refresh by the column-reversal driving is performed consecutively in two frames in the forty-sixth frame and the forty-seventh frame. Therefore, the second refresh frame is provided after the latter refresh frame (the forty-seventh frame) with three times of pause frames put between the refresh frames. That is, the fifty-first and fifty-second frames are refresh frames in which the reversal driving technique is the dot-reversal driving.

<4.3 About Common Electrode Potential>

Incidentally, in the example shown in FIGS. 9 and 10, the common electrode potential is set to VCOM2 when the column-reversal driving is performed, and the common electrode potential is set to VCOM1 when the dot-reversal driving is performed. As thus described, in the present embodiment, the common electrode potential is set to a value that is different between at the time when the liquid crystal panel 300 is driven by the column-reversal driving and at the time when the liquid crystal panel 300 is driven by the dot-reversal driving. By setting the value of the common electrode potential in such a manner, even when the optimum common electrode potential (which is a common electrode potential such that a charging rate at the time of writing with the positive polarity is equal to a charging rate at the time of writing with the negative polarity, and is also called the optimum counter potential) is different between the column-reversal driving and the dot-reversal driving, deterioration in liquid crystal can be suppressed.

<5. Effect>

According to the present embodiment, when the image signal DAT is inputted from the external portion without requesting the external portion to input the image signal DAT, a refresh by the column-reversal driving is performed. Further, when a previously set number of times of pause frames are generated after the previous refresh frame, the request signal RO for requesting the external portion to input the image signal DAT is outputted. Then, a refresh by the column-reversal driving is performed also when the image signal DAT is inputted in accordance with output of the request signal RO. After the refresh frame in which the column-reversal driving has been performed, a refresh frame (second refresh frame) in which the reversal driving technique is the dot-reversal driving is provided with several pause frames (three frames in the present embodiment) put between the refresh frames. From the above, when the image signal DAT is frequently inputted (see the first to sixteenth frames in FIG. 10), a refresh by the dot-reversal driving is not performed, and only a refresh by the column-reversal driving is performed. In contrast, when the frequency of input of the image signal DAT is low, both the refresh by the column-reversal driving and the refresh by the dot-reversal driving are performed. When a refresh is frequently performed, flicker is hardly visually recognized, and hence, even when the column-reversal driving is performed, the display quality does not deteriorate. Instead there is obtained a power consumption reducing effect by performing the column-reversal driving. Moreover, because a refresh by the dot-reversal driving is inserted when the frequency of input of the image signal DAT is low, deterioration in display quality due to flicker is suppressed. From the above, according to the present embodiment, in the liquid crystal display device which performs the pause driving, it is possible to effectively suppress occurrence of flicker while suppressing an increase in power consumption.

Moreover, as described above, after the refresh frame in which the column-reversal driving has been performed, a refresh frame (second refresh frame) in which the reversal driving technique is the dot-reversal driving is provided with a pause frame put between the refresh frames. This prevents deterioration in display quality due to continuing a state where writing into the pixel capacitance is performed by the column-reversal driving for a long time.

Further, the dot-reversal driving is performed in the second refresh frame. In the present embodiment, the second refresh frame is made up of two frames. This suppresses occurrence of screen burn-in caused by deviation of the polarity of the pixel voltage in each pixel.

Furthermore, according to the present embodiment, the potential of the common electrode 33 is set to a different value between at the time when the column-reversal driving is performed and at the time when the dot-reversal driving is performed. For this reason, even when the optimum common electrode potential is different between the column-reversal driving and the dot-reversal driving, it is possible to suppress deterioration in liquid crystal.

Further, when a TFT using an oxide semiconductor for a channel layer is employed as the TFT 31 that is provided in the display portion 30 of the liquid crystal panel 300, a voltage written in a capacitance (pixel capacitance Cp) between the pixel electrode 32 and the common electrode 33 is held over a long time. Hence it is possible to make a refresh rate still lower (make the set value of the foregoing register NREF larger) without causing deterioration in display quality. Accordingly, the frequency of refreshes when the image signal is not inputted from the external portion becomes low, thus allowing significant reduction in power consumption. Especially by employing InGaZnOx as the oxide semiconductor, it is possible to reliably obtain a power consumption reducing effect.

<6 Modified Example>

<6.1 About Frame After Transmission of Request Signal>

In the above embodiment, the column-reversal driving is performed in the second input frame (a frame in which the image signal DAT has been inputted from the external portion by output of the request signal RO to the external portion), a refresh frame (second refresh frame) in which the reversal driving technique is the dot-reversal driving is provided after several frames since the second input frame. However, the present invention is not limited to this. The configuration may be such that "the dot-reversal driving is performed in the second input frame (see the tenth frame in FIG. 11), and the second refresh frame corresponding to the second input frame is not provided" as shown in FIG. 11. However, when the image has changed in the second input frame, it is preferable that the second refresh frame (the fourteenth frame and the fifteenth frame in FIG. 12) corresponding to the second input frame is provided as shown in FIG. 12 such that the pixel voltage reliably reaches a target voltage in each pixel.

<6.2 About Reversal Driving Technique>

In the above embodiment, the reversal driving technique is switched between the column-reversal driving and the dot-reversal driving. However, the present invention is not limited to this. For example, assuming "p >q", the configuration may be such that "a refresh by p-dot-reversal driving is performed in the first refresh frame, and a refresh by q-dot-reversal driving is performed in the second refresh frame". In this case, the p-dot-reversal driving corresponds to the first reversal driving technique, and a q-dot-reversal driving corresponds to the second reversal driving technique. Further, the configuration may be such that "a refresh by the column-reversal driving is performed in the first refresh frame, and a refresh by multi-dot-reversal driving is performed in the second refresh frame". In this case, the column-reversal driving corresponds to the first reversal driving technique, and the multi-dot-reversal driving corresponds to the second reversal driving technique. As described above, the two employed reversal driving techniques are not particularly limited.

DESCRIPTION OF REFERENCE CHARACTERS

10: REVERSAL DRIVING CONTROL PORTION
12: REGISTER GROUP
22: SOURCE DRIVER
24: GATE DRIVER
30: DISPLAY PORTION
31: TFT (THIN FILM TRANSISTOR)
32: PIXEL ELECTRODE
33: COMMON ELECTRODE
100: DRIVER CONTROL PORTION
200: PANEL DRIVING PORTION
300: LIQUID CRYSTAL PANEL

The invention claimed is:

1. A liquid crystal display device, which employs pause driving to provide a pause frame for suspending a refresh of a screen between two refresh frames for performing a refresh of the screen, and performs image display by applying an AC voltage to liquid crystal based on an image signal irregularly inputted from an external portion, the liquid crystal display device comprising:

a liquid crystal panel that includes a plurality of pixel electrodes arranged in a matrix form and a common electrode provided for applying a voltage between the common electrode and the plurality of pixel electrodes through the liquid crystal, and displays an image based on the image signal;

a liquid crystal panel driving portion that drives the liquid crystal panel; and a reversal driving control portion that receives the image signal, decides which of a refresh frame or a pause frame each frame is set to, and decides a reversal driving technique for applying an AC voltage to the liquid crystal to be either a first reversal driving technique where the frequency of the spatial polarity reversal of the voltage applied to liquid crystal is relatively low or a second reversal driving technique where the frequency of the spatial polarity reversal of the voltage applied to the liquid crystal is relatively high, to control an operation of the liquid crystal panel driving portion, wherein, when a frame in which the image signal is inputted from the external portion without requesting the external portion to input the image signal is defined as a first input frame, the reversal driving control portion sets the reversal driving technique in the first input frame to the first reversal driving technique while setting the first input frame to a refresh frame that is defined as a first refresh frame, sets n (n is an integer not smaller than 1) frames subsequent to the first refresh frame to pause frames, sets a frame subsequent to the final pause frame to a refresh frame that is defined as a second refresh frame, and sets the reversal driving technique in the second refresh frame to the second reversal driving technique.

2. The liquid crystal display device according to claim 1, wherein the reversal driving control portion requests the external portion to input the image signal when the image signal is not inputted over a period corresponding to a previously set number of frames.

3. The liquid crystal display device according to claim 2, wherein, when a frame in which the image signal is inputted from the external portion by requesting the external portion to input the image signal is defined as a second input frame, the reversal driving control portion sets the second input frame to a refresh frame that is defined as the first refresh frame in addition to the first input frame, and sets the reversal driving technique in the second input frame to the first reversal driving technique.

4. The liquid crystal display device according to claim 2, wherein, when a frame in which the image signal is inputted from the external portion by requesting the external portion to input the image signal is defined as a second input frame, the reversal driving control portion sets the second input frame to a refresh frame, and sets the reversal driving technique in the second input frame to the second reversal driving technique.

5. The liquid crystal display device according to claim 4, wherein, when an image based on the image signal changes in the second input frame as compared to the previous refresh frame, the reversal driving control portion sets the second input frame to a refresh frame that is defined as the first refresh frame in addition to the first input frame.

6. The liquid crystal display device according to claim 1, wherein the second refresh frame is made up of a plurality of frames.

7. The liquid crystal display device according to claim 1, wherein the first reversal driving technique is a column-reversal driving technique, and the second reversal driving technique is a dot-reversal driving technique.

8. The liquid crystal display device according to claim 1, wherein a potential of the common electrode is set to a value that is different between at the time when the liquid crystal panel is driven by the first reversal driving technique and at the time when the liquid crystal panel is driven by the second reversal driving technique.

9. The liquid crystal display device according to claim 1, wherein the liquid crystal panel includes a scanning signal line, a video signal line which is applied with a video signal in accordance with the image signal, and a thin film transistor where a control terminal is connected to the scanning signal line, a first conduction terminal is connected to the video signal line, a second conduction terminal is connected to the pixel electrode, and a channel layer is formed of an oxide semiconductor.

10. The liquid crystal display device according to claim 9, wherein the oxide semiconductor is indium gallium zinc oxide mainly composed of indium (In), gallium (Ga), zinc (Zn), and oxygen (O).

11. A driving method of a liquid crystal display device, which employs pause driving to provide a pause frame for suspending a refresh of a screen between two refresh frames for performing a refresh of the screen and performs image display by applying an AC voltage to liquid crystal based on an image signal irregularly inputted from an external portion, the driving method comprising:

a liquid crystal panel driving step of driving a liquid crystal panel that includes a plurality of pixel electrodes arranged in a matrix form and a common electrode provided for applying a voltage between the common electrode and the plurality of pixel electrodes through the liquid crystal, and displays an image based on the image signal; and a reversal driving control step of receiving the image signal, deciding which of a refresh frame or a pause frame each frame is set to, and deciding a reversal driving technique for applying an AC voltage to the liquid crystal to be either a first reversal driving technique where the frequency of the spatial polarity reversal of the voltage applied to the liquid crystal is relatively low or a second reversal driving technique where the frequency of the spatial polarity reversal of the voltage applied to the liquid crystal is relatively high, to control an operation in the liquid crystal panel driving step, wherein, when a frame in which the image signal is inputted from the external portion without requesting the external portion to input the image signal is defined as a first input frame, in the reversal driving control step, the first input frame is set to a refresh frame that is defined as a first refresh frame, and the reversal driving technique in the first input frame is set to the first reversal driving technique, n (n is an integer not smaller than 1) frames subsequent to the first refresh frame are set to pause frames, a frame subsequent to the final pause frame is set to a refresh frame that is defined as a second refresh frame, and the reversal driving technique in the second refresh frame is set to the second reversal driving technique.

* * * * *